US007140091B2

(12) United States Patent
Kummel

(10) Patent No.: US 7,140,091 B2
(45) Date of Patent: Nov. 28, 2006

(54) MANUFACTURING PROCESS FOR AN INDUCTIVE COMPONENT

(75) Inventor: Jean-François Kummel, Thionville (FR)

(73) Assignee: Microspire S.A., Illange (FR)

( * ) Notice: Subject to any disclaimer, the term of this patent is extended or adjusted under 35 U.S.C. 154(b) by 0 days.

(21) Appl. No.: 10/085,309

(22) Filed: Feb. 28, 2002

(65) Prior Publication Data

US 2002/0084881 A1 Jul. 4, 2002

(51) Int. Cl.
*H01F 7/129* (2006.01)

(52) U.S. Cl. ..... 29/602.1; 29/605; 29/606; 29/848; 264/272.16; 264/272.19; 264/272.2

(58) Field of Classification Search ..... 29/602.1, 29/604, 605, 606, 607, 848; 264/272.16, 264/272.19, 272.2; 336/90, 96, 192, 198, 336/200, 223, 232; 360/90, 96, 192, 198, 360/200, 223, 232

See application file for complete search history.

(56) References Cited

U.S. PATENT DOCUMENTS 4,370,292 A * 1/1983 Yanase et al. ..... 264/272.19 X
4,553,123 A 11/1985 Tamada et al.
4,745,388 A * 5/1988 Billings et al. ..... 336/192

FOREIGN PATENT DOCUMENTS

| | | | | |
|---|---|---|---|---|
| DE | 195 44 915 A1 | | 12/1995 | |
| DE | 196 28 897 A1 | | 7/1996 | |
| EP | 0 741 396 A1 | | 11/1996 | |
| JP | 1-226129 | * | 9/1989 | ..... 29/602.1 |
| JP | 04338617 | | 11/1992 | |
| JP | 5-109540 | * | 4/1993 | ..... 29/602.1 |

* cited by examiner

*Primary Examiner*—A. Dexter Tugbang
(74) *Attorney, Agent, or Firm*—Boyle Fredrickson Newholm Stein & Gratz S.C.

(57) ABSTRACT

A process for manufacturing an inductive component intended to be installed on a printed circuit involves initially winding an electrically conductive wire to form a winding without using a former end connecting the opposed ends of the winding to inner ends of connecting terminals. The body formed of a block of an insulating material is then over-moulded onto the coil and onto the inner ends of the connecting terminals with the body including a central opening that passes through the body along the axis of the coil. Finally, a core made of ferrite is placed on the body such that the core surrounds the body in a center plane containing the axis of the coil with a center core element passing through the opening in the body.

10 Claims, 4 Drawing Sheets

MANUFACTURING PROCESS FOR AN INDUCTIVE COMPONENT

CROSS-REFERENCE TO A RELATED APPLICATION

This application claims priority under 35 U.S.C. §120 to U.S. patent application Ser. No. 09/509,747, filed Mar. 30, 2000, now U.S. Pat. No. 6,486,763, the entirety of which is incorporated by reference herein.

BACKGROUND OF THE INVENTION

1. Field of the Invention

This invention concerns inductive components, of the type including one or more windings, and which can be used therefore depending on case as inductors or alternating current transformers. Such components, as inductors, are generally used to perform in electric or electronic circuits the filtering, smoothing or energy storage functions, being conventionally traversed by currents with a DC component on which an AC component is superimposed. A current operating frequency range is 10 kHz to 3 MHz. Such components are for instance currently used in switched power supplies or DC converters. Also, these components are conventionally made so that they can be installed on printed circuits in a manner known itself.

2. Description of the Related Art

Known inductors of the type mentioned above generally consist of one or more enamelled copper wire windings made on a toroidal core supported by a base including connecting pins. Conventionally, especially to reduce the overall surface area on the printed circuit, the toroidal windings are arranged vertically on the base so as to extend perpendicularly to the surface of the printed circuit. The ends of the wires are connected to the connecting pins or themselves form the said pins which are intended to be inserted into holes drilled in the printed circuit or soldered to it in a conventional manner. Although it is possible to also adopt a surface-mounted component (SMC) type design which is more suited to automatic installation, the high volume and weight of these components generally prohibits such a design and these components must be mounted manually on the printed circuit before soldering. Also, the mechanical strength in cases of strong vibrations is not very reliable on account of the high weight and the relative distance of the core from the printed circuit when compared with the relatively small dimensions of the base.

Moreover, the magnetic materials used for the toroidal core are generally iron powder based, for example, iron-silicon, when the planned operating frequencies are low, up to 100 kHz, or when the frequencies are higher, up to 200 kHz, made of a ferronickel alloy such as permalloy, for instance the material currently known under the name of Moly-Permalloy or MPP, which is a sintered iron and nickel powder with 80 or 50% nickel.

These two materials have the advantage of supporting a high DC magnetic field which enables the section of the core, and therefore the overall size of the component to be reduced.

However, their losses are high when used at high frequencies, that is around several hundred kHz to several MHz and therefore are poorly suited to uses such as in converter switching power supply circuits which increasingly use very high frequencies.

Another disadvantage of toroidal-type windings is that they are not sealed, the wire being simply wound around the toroidal core without external protection.

OBJECTS AND SUMMARY OF THE INVENTION

The purpose of this invention is to solve these problems and especially aims at supplying an inductive component with a low weight and a low volume, limiting the losses when used at high frequencies and where installation can be facilitated and automated by authorising the design of these components as surface-mounted components (SMC).

With these targets in mind, the subject of the invention is an inductive component intended to be installed on a printed circuit. The inductive component includes first and second connecting terminals for connecting the inductive component to the printed circuit. The first and second connecting terminals having inner ends. The inductive component also has a conductive electric wire having a first end operatively connected to the inner end of the first terminal and a second end operatively connected to the inner end of the second terminal. The wire, which has a coating for retaining the shape of the coil, is wound about an axis to form a coil. The inductive component also has a body formed from a block of insulating material having a lower face orthogonal to the axis. The body is overmolded onto the coil and onto the inner ends of the first and second terminals. The body defines a central opening therethrough, which extends along the axis. In a first preferred embodiment, the body is made from a thermosetting epoxy resin. In a second preferred embodiment, the body is made from a thermoplastic polymer. A magnetic core is positioned between the first and second connecting terminals. The magnetic core is formed of ferrite and has a central element passing through the central opening through the body.

The combination of characteristics according to the invention especially has the advantage of providing a significant gain in volume and in weight when compared with inductive components with equivalent properties made in the form of toroidal core inductors: a component according to the invention takes up, for instance, a volume of 1200 $mm^3$ whereas an equivalent inductor with a toroidal core takes up a volume of around 3240 $mm^3$. These advantages result especially from the use of a winding with a low height and of a ferrite magnetic core, which, thanks to its magnetic characteristics, enables a reduction in the section. Ferrites have low losses at high frequencies and such a material is therefore especially suitable for the applications targeted by the component according to the invention that is for frequencies of up to 3 MHz, such as, for example, converter switching power supplies where the switched frequencies tend to be increasingly higher. Also, the low height of the component enables a reduction in the overall thickness of the printed circuit on which it is mounted.

The body, for example made of a thermosetting epoxy resin or a thermoplastic polymer, overmoulded directly on the coil and the connections, provides high mechanical strength, good dissipation of the losses generated by passing the current through the winding and good sealing enabling the component to be used in wet environments. The fact of not including the ferrite core in the moulding but adding it around the body, and externally apparent, improves still further the dissipation of the thermal energy generated especially by the eddy currents this thanks to direct contact of a large external surface area of the core with the exterior and the possibility of easily associating a heat sink.

According to a specific arrangement of the invention, the core consists of two elements extending respectively on each of the faces of the body, one at least of the said elements being E-shaped the centre arm of which passes through the opening of the body and the outer arms of which pass on two opposite sides of the said body. This arrangement offers, at same volume and when compared with the use of ferrite cores made in known forms, for instance a toroidal form, a much higher iron section. For an equivalent induction level, the number of turns of the winding can therefore be reduced which reduces the losses in the conducting wire and therefore enables a higher current.

This design of the ferrite cores also enables an air gap to be easily made in the magnetic circuit between the two elements comprising the core, at the level of the outer faces of at least one of the arms of the E. This air gap can be adapted for instance by playing on the respective lengths of the arms of the E. This air gap enables the core to support a high DC field and, correlatively, for a given field, a reduction in the volume of the core.

Preferably, the two elements of the core are bonded to each other when they are installed on either side of the body. The adhesive joint, made by a non-magnetic adhesive at the interface between the two elements of the core can moreover be placed in the air gap mentioned above at the level of one or more of the arms of the E. The securing of the core on the body can be completed by an additional adhesive joint placed between the edges of the elements of the core and the body, in particular, on the sides of the component.

According to another specific arrangement, the connecting terminals emerge from the body at the level of the lower face of the body, on two opposite sides of the body in relation to the said centre plane. These terminals are secured to the body by overmoulding. The outer ends of these terminals may be shaped to form pins for conventional installation on printed circuits. They will however preferably be shaped so as to form lugs extending in the plane of the lower surface of the body or slightly prominent, enabling the component to be attached to the printed circuit by the soldering of these lugs to the surface of the said circuit according to the technique known for SMCs.

The low height of the component associated with much larger transverse dimensions, especially the distance between the lugs located on each side of the component, and the low weight considerably improve the vibration resistance when the component is soldered to the circuit.

The lugs, in addition to ensuring a mechanical attachment function to the printed circuit by soldering, at least those to which the ends of the winding or windings are connected are used of course for their electrical connections. Note, on this subject, a specific advantage resulting from the SMC-type design according to the invention which lies in the large contact surface area possible between the lugs and the printed circuit which enables very low connection resistances and high currents to be obtained. This advantage is even more marked when, as can be achieved when the component includes only a single winding, this winding is connected to connections which extend along the complete length of the sides of the component.

Again, another advantage of the inductive components according to the invention is that they can be packed in strips for use by automatic installation machines, their flattened format and their low weight authorising automatic installation by suction or by grips.

The subject of the invention is also a manufacturing process for an inductive component intended to be installed on a printed circuit and including at least one winding and a magnetic core, this including steps of winding a wire having ends, without using a former, to form a winding in the form of a flat coil. The ends of the winding are connected to inner ends of connecting terminals. A body is overmoulded from a block of an insulating material onto the coil and onto the inner ends of the connecting terminals so that a lower face of the body is at least generally orthogonal to an axis of the coil. The body includes a central opening formed therethrough which passes along the axis of the coil. A core made of ferrite is placed on the body such that the core surrounds the body in a center plane containing the axis of the coil and has a center core element passing through the opening of the body.

Preferably, the winding is made with a wire including an outer thermobonding layer and, after winding, an electric current of sufficient amperage is passed through the wire to heat it and to obtain the bonding of the turns to each other.

Other characteristics and advantages will appear in the description which will be given of a component in compliance with the invention and its manufacturing process.

BRIEF DESCRIPTION OF THE DRAWINGS

Refer to the appended drawings on which.

DETAILED DESCRIPTION OF THE PREFERRED EMBODIMENTS

1. Construction of a First Preferred Embodiment of Inductor

Figure 1:
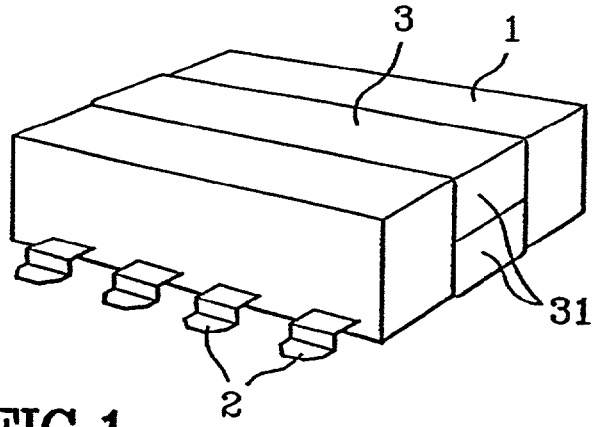
FIG. 1 shows a perspective view of an inductor in compliance with the invention.

The inductor shown on FIG. 1 includes a body 1 from which emerge, on each side, connecting lugs 2 and a ferrite magnetic core 3. In a first preferred embodiment, the body is for example made of a thermosetting epoxy resin or of a similar material adapted for shaping by overmoulding on a winding 4 as can be seen especially on FIGS. 8 and 11. The core consists of two elements 31 with an E-shaped section placed either side of the body. The ferrite used is for example of the power ferrite type with low losses, with a utilisation frequency range of 10 kHz to 5 MHz and a relative permeability of 200 to 2500 or any type of ferrite with a high relative permeability of around 3000 to 15000.

The winding 4 consists of an insulated conductive wire including a thermobonding resin coating such as for example an enamelled copper wire of the Thermibond R type. This wire is wound in the form of a rectangular-shaped coil as can be seen on FIG. 5 by winding the wire on a mandrel of suitable size. The maintaining of the form of the turns and the bonding of the turns together to obtain a mechanical strength for the coil is ensured by thermobonding, by passing through the wire a calibrated electric current enabling its temperature to be raised by the Joule effect to around 180° C. to ensure the melting of the coating and the bonding of the turns after cooling. The coil can then be removed from the mandrel without distorting it. This type of winding without using a supporting former enables the overall size of the coil to be reduced to a minimum and ensures better heat dissipation during use.

Figure 4:
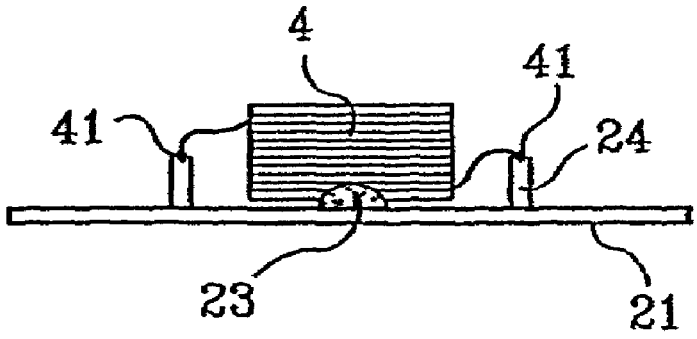
FIGS. 4 and 5 show respectively a front and top view of the installation of the winding on the grid intended to subsequently form the connecting lugs.
Figure 5:
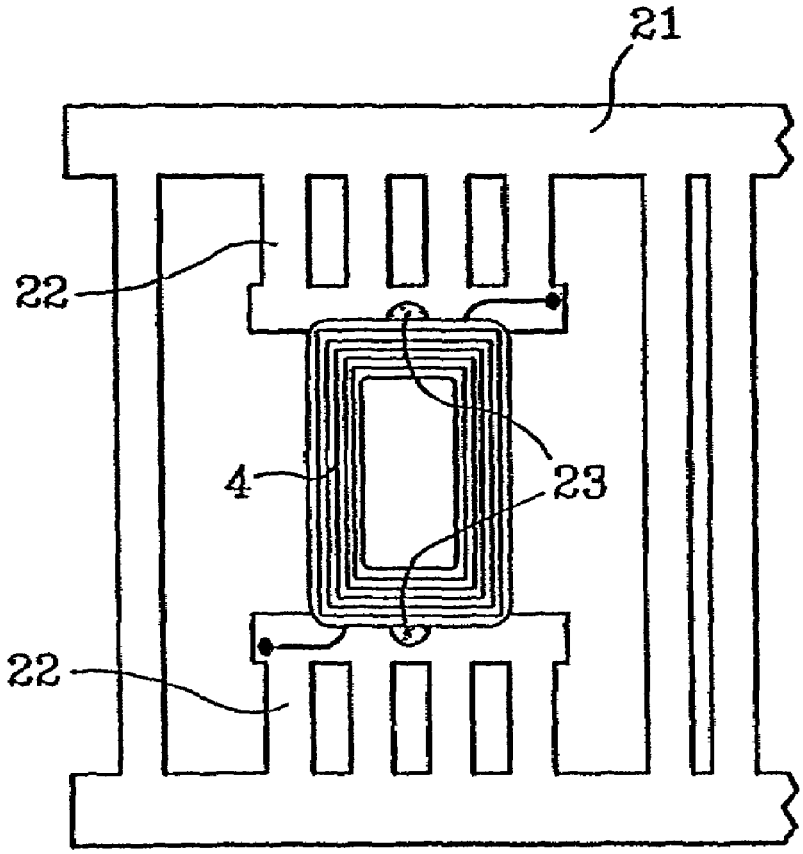

As can be seen on FIGS. 4 and 5, the winding 4 is then installed on a grid 21 made of a conductive metal, for example, a tinned copper alloy. The grid 21 is shaped so as to position the elements 22 extending on each side of the coil and intended to form the connecting lugs 2 as will be seen later. The ends 41 of the wire are soldered to the inner ends 24 of the elements 22 by adding tin at a high temperature, around 300° C., with a soldering iron or any other equivalent procedure. In the example shown, where only one coil is thus installed, the elements 22 located on the same side of the coil can be connected together. If the component includes several windings, the elements 22 would be separated, each element 22 being capable of accommodating an end of a winding. The adhesive spots 23 temporarily secure the winding to the grid.

Figure 6:
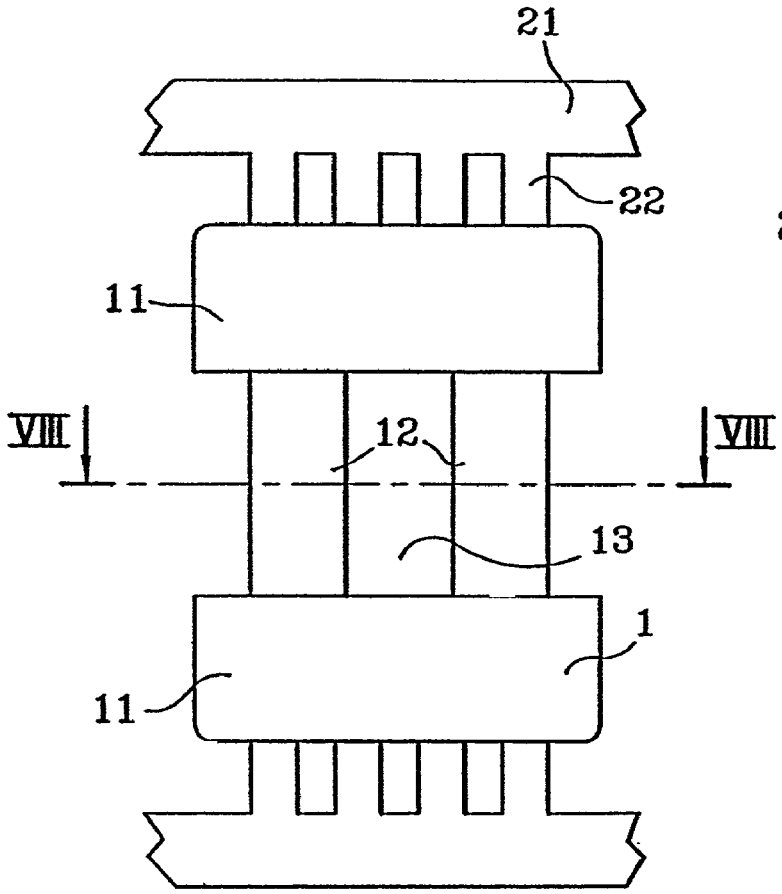
FIG. 6 shows a top view of the component after moulding the body.
Figure 7:
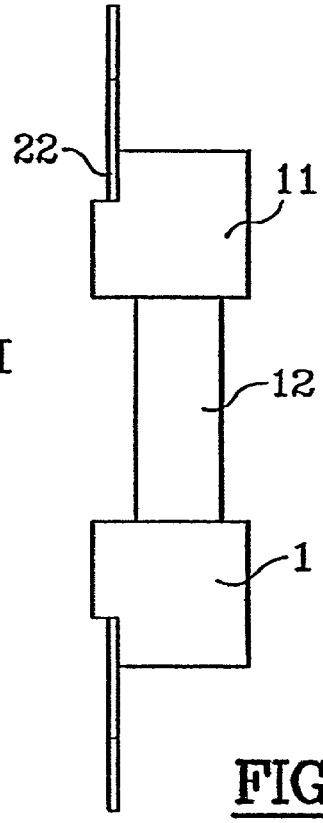
FIG. 7 shows a side view of the body.
Figure 8:
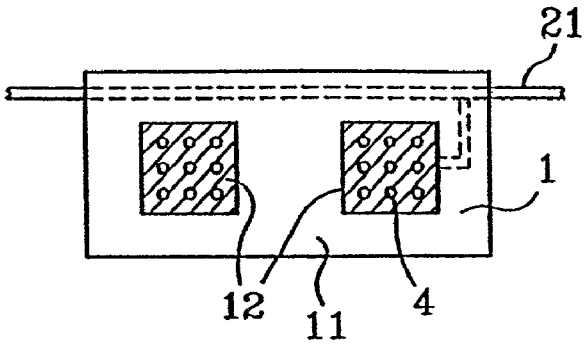
FIG. 8 shows a sectional view through line VIII—VIII of FIG. 6.
Figure 9:
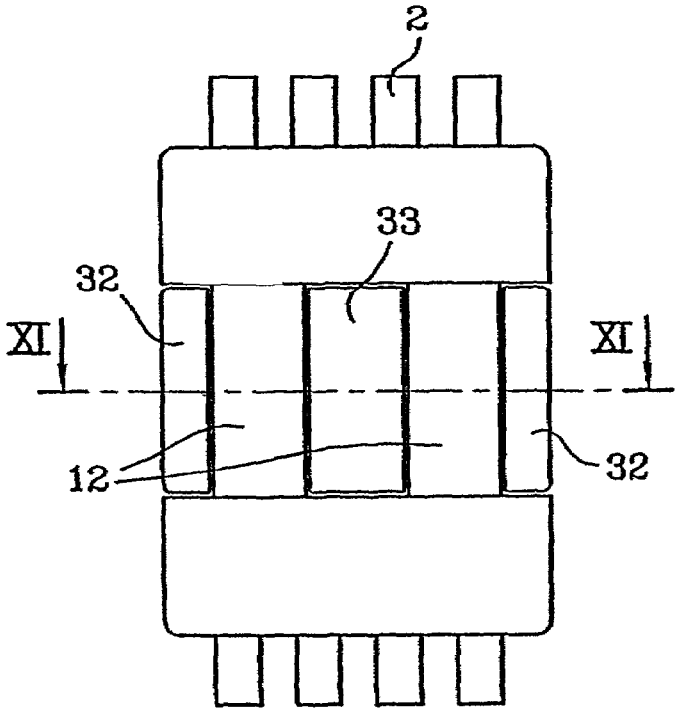
FIG. 9 shows the component after installation of one of the two core elements.

The body 1 is then overmoulded on the assembly thus obtained so as to embed the winding and the coil connections to the grid in the resin as shown on FIGS. 6 and 8 and to obtain body 1 with two lateral sections 11 located symmetrically in relation to the centre plane P and from where emerge the elements 22 of the grid and two transverse sections 12 making a central opening 13 which passes through the body in the direction of the coil axis.

Figure 10:
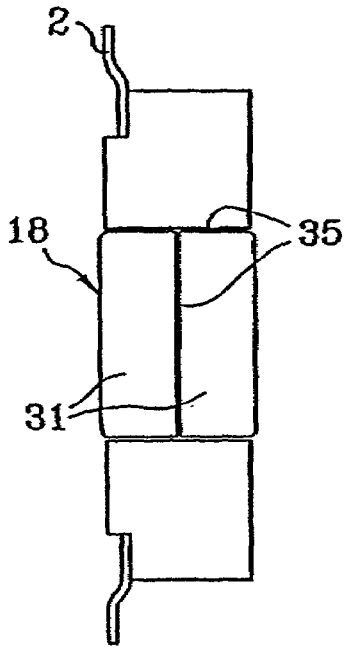
FIG. 10 shows a side view of the finished component.
Figure 11:
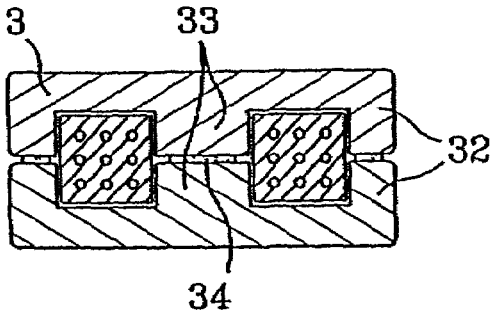
FIG. 11 shows a sectional view of the component through line XI—XI of FIG. 9, with the complete core.

The two elements 31 of the core are then placed on either side of the body as shown on FIG. 11, the outer arms 32 of the E passing on the outside of the transverse sections 12 of the body and the centre arms 33 passing through opening 13. The ferrite elements 31 are secured by layers of adhesive 34, 35 applied respectively between the end faces of the arms of the Es and on the sides between the ferrite elements and the body as shown on FIGS. 10 and 11.

Moreover, the elements 22 of the grid are cut and shaped by bending to comprise the connecting lugs 2 which extend more or less in the plane of the lower face 18 of the inductor.

Figure 2:
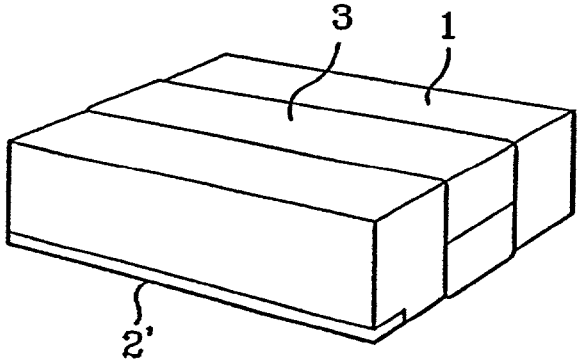
FIGS. 2 and 3 show two other design variants.

The drawing on FIG. 2 shows a design variant usable for an inductor including a single winding. The lugs 2 located on the same side are then replaced by a strip 2' which extends at the corner of the component along its complete length.

Figure 3:
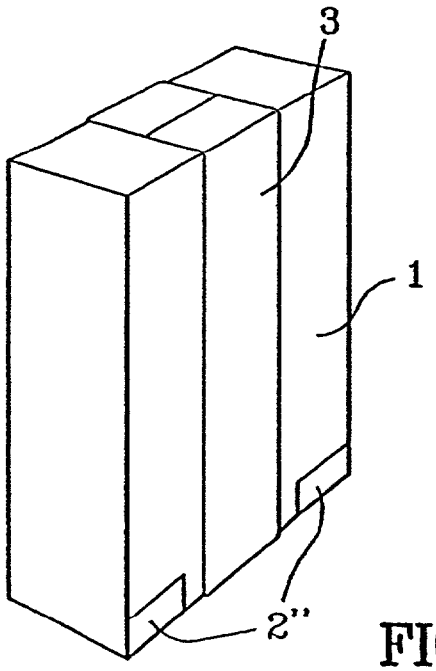

The drawing of FIG. 3 shows yet another variant where the connecting terminals 2" are made only on the edges of the lateral sections 11 of the body, such a component being especially installed perpendicular to the surface of the printed circuit.

These components can be manufactured as described above by simply adapting the shape of the grid to suit.

2. Construction of a Second Preferred Embodiment of Inductor

In a second preferred embodiment, instead of a thermosetting epoxy resin, the body is made of a thermoplastic polymer than can be injected at temperature higher than 30020 C. for example.

In fact, using a thermosetting polymer, such as epoxy resin, can be made more easily by a classical epoxy transfer molding encapsulation process, because lower temperatures are required. But the fabricating process requires a longer cycle time.

Comparatively, the cycle time, when using an injectable thermoplastic polymer, is far shorter. However, the required temperature of injected plastic is higher, and can reach temperatures which are substantially equal or even a little bit higher than melting point of some of the materials that are overmoulded.

It has been experimentally and surprisingly proved that such an injection process can be used to make the component according to the invention, without noticeable degradation, even when the temperature of the injected plastic is higher than the molding point of the insulating coating of the coil wires. In fact, it has been supposed, while not yet clearly explained, that the protective coatings of the coil wires and connecting means is perhaps a little degradated but that this slight degradation is compensated by the injected thermoplastic that serves as a protective coating.

Typically, the process comprises the step of fabricating and assembling the coil onto the grid, as mentioned in the first embodiment. Then, the coil assembly is placed into a mold of the type classically used for injection process and conformed to the required design of the final component body.

A thermoplastic polymer is then injected under pressure in the mould, at the required temperature for the chosen polymer, so that it wraps the coil and connecting wires assembly and fills the mould, which is cooled, then opened to extract the component.

The injection process is typically a liquid crystal polymer (LCP) injection process, wherein the polymer is, for instance, VECTRA E 130 I LCP plastic, commercialized by HOECHST Chemical, or a similar material. The plastification temperature is higher than 300° C., and the moulding pressure is 40 to 60 bars, (around 740 psi). The injection cycle time is less than 15 seconds.

The invention is not limited to the designs described above only as examples. In particular, the winding could include several elements, separate or connected together, to make various types of transformers or inductors. Also, the core could be made of a single E-shaped section with longer branches and the other section being flat.

What is claimed is:

1. A process of manufacturing an inductive component intended to be installed on a printed circuit and including at least one winding and a magnetic core, the process comprising:

winding a wire having ends to form a winding in the form of a flat coil, the winding step being performed without using a former;

connecting the ends of the winding to inner ends of connecting terminals;

overmoulding a body from a block of an insulating material onto the coil and onto the inner ends of the connecting terminals so that a lower face of the body is at least generally orthogonal to an axis of the coil, the body including a central opening formed therethrough which passes along the axis of the coil; and placing a core made of ferrite on the body such that the core surrounds the body in a center plane containing the axis of the coil and has a center core element passing through the opening of the body.

2. A process in accordance with claim 1, wherein the wire includes a thermobonding outer layer, and further comprising passing an electrical current through the wire of an amperage sufficient to heat the wire to bond turns of the winding together.

3. A process according to claim 1, further comprising bonding the coil to a grid that has the connecting terminals formed thereon.

4. A process in accordance with claim 1, wherein the core comprises core elements bonded to each other with a non-magnetic adhesive.

5. A process in accordance with claim 1, wherein the core is made of two elements, wherein each of the elements extends along a respective face of the body, wherein one of the elements is E-shaped so as to have a center arm and two outer arms, and wherein, during the placing step, the center arm of the E-shaped element passes through the opening of the body and the outer arms pass along two opposite sides of the body.

6. A process in accordance with claim 1, wherein the step of overmoulding is performed via a transfer moulding encapsulation process using a thermosetting epoxy resin.

7. A process in accordance with claim 1, wherein the step of overmoulding is performed via an injection process using a thermoplastic polymer.

8. A process in accordance with claim 7, wherein, during the injection process, the thermoplastic polymer is injected at a temperature higher than 3000° C.

9. A process in accordance with claim 7, wherein, during the injection process, the injection pressure ranges from to 40 to 60 bars.

10. A process in accordance with claim 7, wherein the injection cycle time of the injection process is less than 15 seconds.

* * * * *